US007093729B2

(12) United States Patent
Monteil et al.

(10) Patent No.: US 7,093,729 B2
(45) Date of Patent: Aug. 22, 2006

(54) BALLASTING DEVICE FOR A CRANE

(75) Inventors: Philippe Monteil, Chemilly (FR); Yves Millet, Moulins (FR)

(73) Assignee: Potain, Ecully (FR)

( * ) Notice: Subject to any disclaimer, the term of this patent is extended or adjusted under 35 U.S.C. 154(b) by 199 days.

(21) Appl. No.: 10/812,033

(22) Filed: Mar. 30, 2004

(65) Prior Publication Data

US 2004/0256342 A1 Dec. 23, 2004

(30) Foreign Application Priority Data

Apr. 30, 2003 (FR) ..... 03 05362

(51) Int. Cl.
*B66C 23/72* (2006.01)

(52) U.S. Cl. ..... 212/178; 212/195; 294/81.56

(58) Field of Classification Search ..... 212/178, 212/295; 294/81.56
See application file for complete search history.

(56) References Cited

U.S. PATENT DOCUMENTS 3,278,045 A * 10/1966 Potter et al. ..... 212/178
4,128,267 A * 12/1978 Niblett et al. ..... 294/81.56
4,316,696 A * 2/1982 Hoyerman ..... 414/542
5,615,784 A * 4/1997 Pech et al. ..... 212/178
6,039,374 A 3/2000 Dieter
6,871,427 B1 * 3/2005 Muta et al. ..... 37/466

FOREIGN PATENT DOCUMENTS

| | | |
|---|---|---|
| EP | 1 205 422 A1 | 5/2002 |
| EP | 1 293 467 A | 3/2003 |
| FR | 1 366 878 A | 7/1964 |

* cited by examiner

*Primary Examiner*—Thomas J. Brahan
(74) *Attorney, Agent, or Firm*—Oliff & Berridge, PLC

(57) ABSTRACT

The device combines ballast blocks (3) that can be stacked onto a base frame of the crane, and a gripper (2) for handling these blocks, the gripper being designed to be connected, during use, to a handling means. This device comprises means of nonpermanent connection, by hooking, between the gripper (2) and a ballast block (3) and means (34, 37, 38) for centering the stacked ballast blocks (3) relative to one another. The aforementioned connection means are constituted by two opposed gripping hooks (15, 16) mounted pivotably at the ends of a lifting beam (4) of the gripper (2) and interacting with transverse pins (35) of a block (3). The rear part of each hook (15, 16) is attached to a sling (27, 28), and a lock (21, 22) is assigned to it. The invention applies in particular to the ballasting of tower cranes.

12 Claims, 5 Drawing Sheets

BALLASTING DEVICE FOR A CRANE

The present invention relates to the technical field of cranes, in particular tower cranes. This invention concerns, more particularly, a device intended for ballasting such a crane with the aid of concrete blocks that can be stacked onto a base frame of the crane, the ballasting device combining the ballast blocks and means for handling these blocks, allowing the ballast blocks to be positioned without manual intervention.

Published European Patent Application EP 1205422 A1 already describes a device for gripping ballast blocks intended to be stacked at the base of a crane, in particular of a tower crane, this known device combining:

- on the top of the ballast blocks, outwardly directed hooks housed inside cavities whose shape is adapted to the lateral guiding of gripper rollers and to the maximum travel of the gripper;
- a gripper connected (during use) to a hoisting cable actuated by a winch of the crane, the gripper being composed of two arms articulated to one another by one of their ends and provided at their other respective end with an open part designed to engage in a hook of the ballast blocks, this other end also being equipped with rollers, while articulated levers are provided for opening or closing the arms of the gripper;
- a system for centering the ballast blocks, which on the one hand uses protuberances of trapezoidal profile on the upper face of these blocks and corresponding cavities in the lower face of the same blocks, a cavity of an upper block being designed to interact with a protuberance of a lower block, and on the other hand stirrups provided on one side of the ballast blocks, at their upper part, and corresponding recesses made in the lower part of the blocks, each recess of an upper block being designed to interact with a stirrup of a lower block, the stirrups thus constituting ladder rungs used by the operators.

This known device has various drawbacks:

- The required shape of the ballast blocks is particularly difficult to produce, especially with regard to the cavities with a sloping wall, the precise positioning of the hooks in these cavities, the protuberances and recesses of trapezoidal profile, and the installation of the lateral stirrups and also the production of the corresponding recesses.
- The guide rollers, provided at the ends of the gripper arms, constitute fragile parts that are exposed to impact during use.
- All of the levers used for unlocking the ballast blocks have a low degree of reliability, taking account of the relative positions of their hinge pins.
- The centering system is complex insofar as it requires separate elements for the longitudinal relative positioning and the transverse relative positioning of the stacked ballast blocks.
- When the device is being used, the operator's safety is not guaranteed if he inserts an arm or a finger into the articulated components.

Overall, even though it claims to require only a single operator to perform ballasting, the known device mentioned here therefore remains complex and costly, and difficult and dangerous to use.

The present invention aims to eliminate all of the drawbacks stated above and its main aims are therefore to provide a ballasting device for a crane that:

- allows ballasting and de-ballasting operations, i.e. the positioning and removal of the ballast blocks, to be performed by a single operator with an effective saving in time and labor and providing complete safety for this operator;
- uses ballast blocks of simple configuration that can be produced industrially in an economic manner;
- comprises a simple and precise system for centering the ballast blocks relative to one another;
- also comprises a simple system for centering the gripping means on a ballast block to be handled;
- constitutes overall a simple, robust, and therefore reliable, device whose principle is based in particular on the articulated components operating by gravity.

To this end, the subject of the invention is a ballasting device for a crane, in particular for a tower crane, of the type concerned here, i.e. combining ballast blocks that can be stacked onto a base frame of the crane and a gripper for handling the ballast blocks, the gripper being designed to be connected, during use, to a handling means, this device comprising, in a known manner, means of nonpermanent connection, by hooking, between the gripper and a ballast block, and also means for centering the stacked ballast blocks relative to one another, and said device being essentially characterized in that the aforementioned means of nonpermanent connection comprise two opposed gripping hooks mounted pivotably, about horizontal pins, in the end regions of a lifting beam of the gripper, each gripping hook having, on one side of its pivot pin, a hooking catch designed to interact with a transverse pin placed in a corresponding housing of a ballast block, and, on the other side of its pivot pin, a rear part attached to a sling by which the gripper is suspended from the hoisting cable, each gripping hook being assigned a lock that is borne by the lifting beam and designed to temporarily keep the corresponding gripping hook in the position in which the transverse pin is released.

Thus, the invention provides a ballasting device that is particularly easy to use, the device comprising hooks mounted on the gripper and no longer on the ballast blocks, and the only manual intervention required being to unlock the hooks before a ballast block is hoisted, while the other movements are controlled by gravity and by the action of the slings on the gripping hooks.

In a simple embodiment, the lifting beam is constituted by two parallel bars or profiles that are secured to one another with a longitudinal gap left between them, so as to form, at the two ends of the lifting beam, devises serving for the articulation of the two suspension hooks.

Vertical protective plates are advantageously fastened onto the two bars or profiles of the lifting beam, these plates protecting the region in which the rear part of the gripping hooks travels, for the safety of the operator.

Preferably, the rear part of each gripping hook itself constitutes, or bears, a counterweight, which allows the gripping hooks to automatically release the transverse pins of the ballast block when the latter is placed and when the slings are slackened.

Advantageously, each sling forms an angle of less than 180° with the longitudinal axis of the corresponding gripping hook, which ensures that the gripping hooks are kept in position on the transverse pins of the ballast block, under the effect of the weight of this block.

In an advantageous embodiment, each lock of the gripper is a lock mounted pivotably about a horizontal pin borne by the lifting beam, the lock having a bent shape, with a lower part forming a counterweight, and an upper part that forms a locking catch and is provided with a ramp intended to interact with a control finger borne by the rear part of the corresponding gripping hook.

According to another aspect of the invention, the ballast blocks, made essentially of concrete, each comprise two metal grip parts, embedded in the concrete, that each delimit a housing capable of receiving a gripping hook, each metal grip part being provided with a transverse pin passing through the housing delimited by said part and designed to interact with the locking catch of a gripping hook engaged in this housing.

Two right-angle positioning brackets are advantageously fastened under the lifting beam, these brackets being designed to interact, respectively, with the upper edges of the housings delimited by the two grip parts of a ballast block; these brackets center the gripper on a ballast block to be hooked, when the lifting beam is placed on the upper face of the ballast block.

In a preferred embodiment, the means for centering the stacked ballast blocks relative to one another comprise, on each ballast block, conical centering pegs that protrude above the upper face of the ballast block, and corresponding housings of flared shape, in particular of conical or pyramidal shape, that open out in the lower face of the ballast block. These pegs and complementary housings provide, by themselves alone, for two directly superposed ballast blocks to be relatively positioned both longitudinally and transversely, and they allow certain tolerance variations in the manufacture and placing of the blocks.

According to an embodiment that is advantageous from the point of view of manufacture of the device and the precision with which it is produced, the centering pegs and the corresponding housings belong to metal centering parts, each metal centering part extending vertically over one side of a metal grip part and being attached to the latter to constitute a single metal insert embedded in the concrete of the ballast block.

Finally, the lifting beam is advantageously provided at its ends with rings designed to receive a guide rope that can be used while handling a ballast block hooked in under the lifting beam, the rope being intended to be held by an operator who remains stationed on the ground.

The invention will be better understood with the aid of the description that follows, with reference to the appended schematic drawing representing, by way of example, an embodiment of this ballasting device for a crane:

Figure 1:
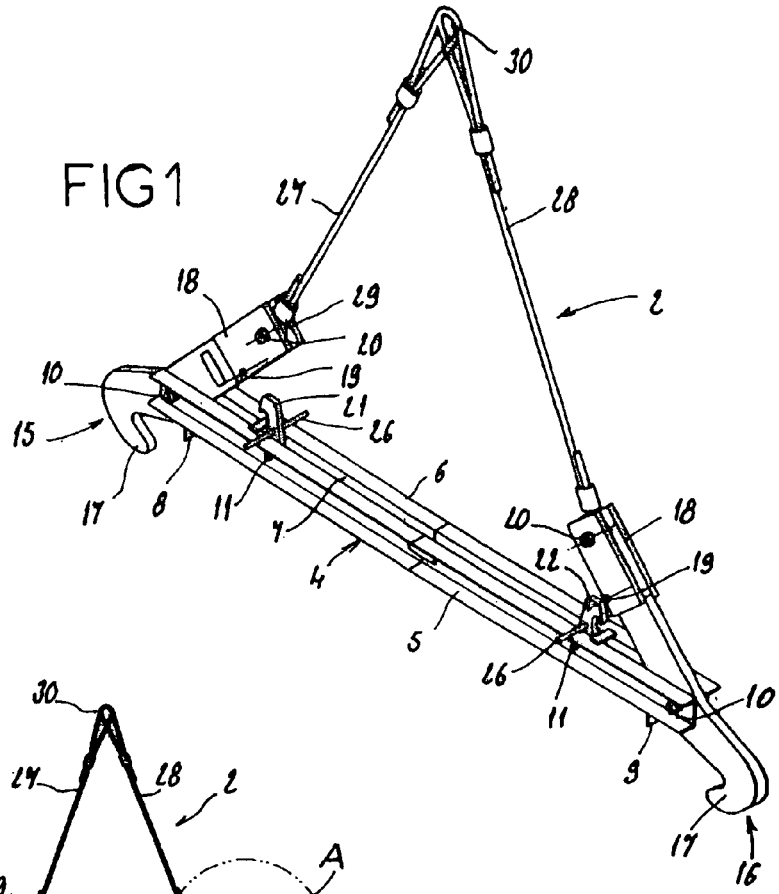
FIG. 1 is a perspective overall view of a gripper of a device according to the present invention.

The ballasting device for a crane, represented in the drawing, consists of a gripper 2 and ballast blocks 3, the gripper 2 being adapted to the ballast blocks 3.

Figure 2:
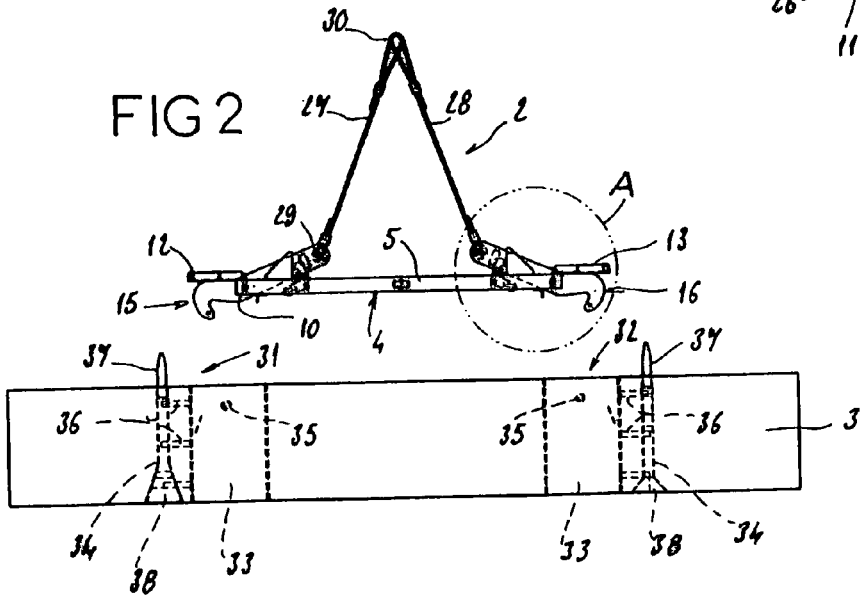
FIG. 2 is a front view showing all of the device according to the invention, with the gripper taking up position above a ballast block.
Figure 3:
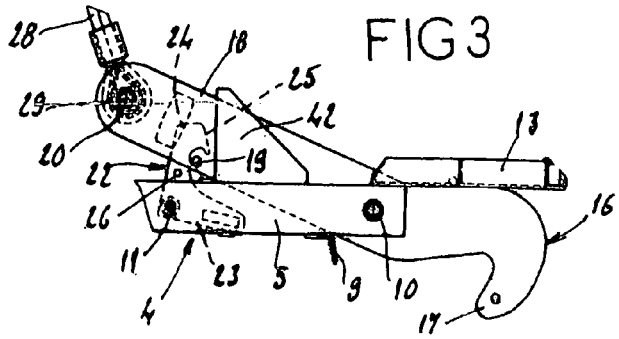
FIG. 3 is a view on an enlarged scale of the detail A of FIG. 2, showing more particularly a hook of the gripper in the locked position.

The gripper 2 is represented in its entirety in FIGS. 1 and 2, FIG. 3 representing, on an enlarged scale, a detail A of this gripper 2.

The gripper 2 comprises a lifting beam 4 constituted by two "U"-shaped profiles 5 and 6 that are parallel, opposed with respect to one another, and secured to one another, a gap 7 being made between the two profiles 5 and 6 over the total length of these profiles. The two profiles 5 and 6, thus slightly spaced apart, form two devises situated one at each of the two ends of the lifting beam 4.

Two transverse right-angle positioning brackets, 8 and 9 respectively, are welded onto the lower part of the lifting beam 4, therefore under the lower flanges of the two profiles 5 and 6.

Vertical triangular protective plates 42 (omitted from FIG. 1) are welded onto the upper part of the lifting beam 4, more particularly onto the two profiles 5 and 6.

At each end, in its clevis-forming part, the lifting beam 4 comprises two coaxial holes made in the vertical webs of the two profiles 5 and 6, respectively, and receiving a horizontal hinge pin 10 for a pivoting gripping hook (described hereinafter).

Toward each end, but to the rear of the coaxial holes receiving the aforementioned hinge pin 10, the lifting beam 4 comprises two other coaxial holes made in the vertical webs of the two profiles 5 and 6, respectively, and receiving a horizontal hinge pin 11 for a pivoting lock (described hereinafter).

Figure 8:
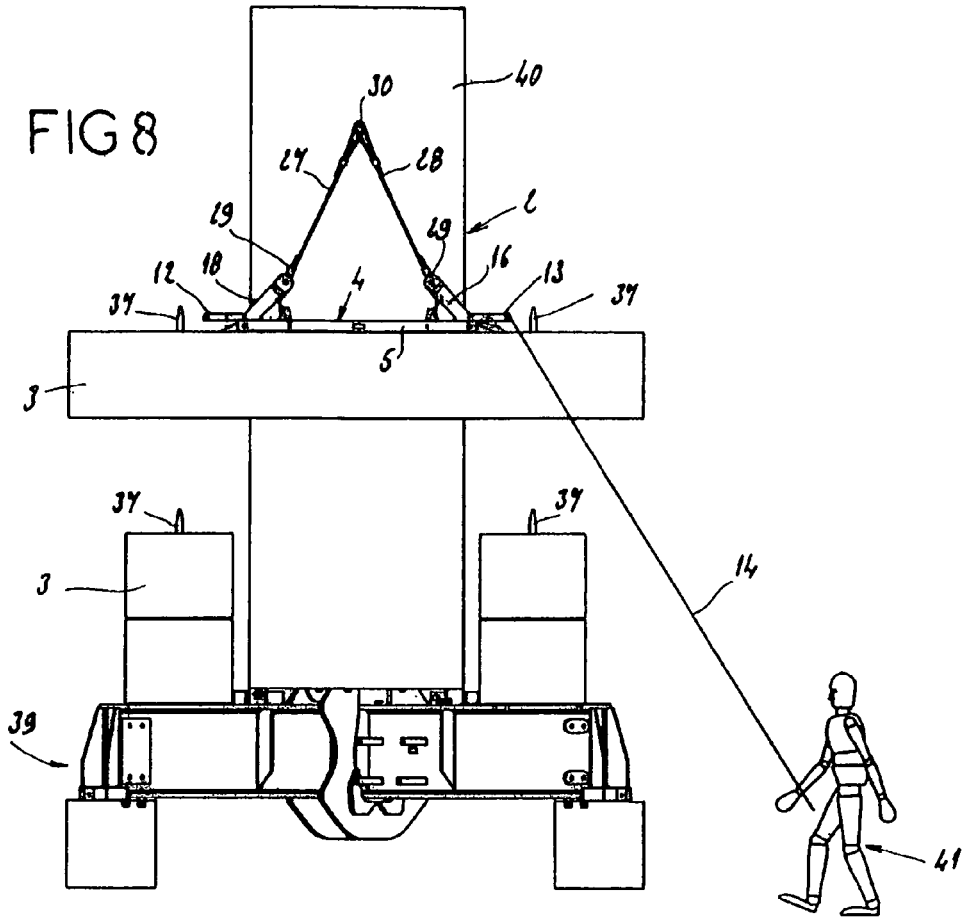
FIG. 8 is another front view illustrating the guiding of the ballast block during handling.

At each of its ends, the lifting beam 4 is additionally provided with two horizontal rings, 12 and 13 respectively (not indicated in FIG. 1 but visible in the subsequent figures). Each ring 12 or 13, welded onto the end parts of the two profiles 5 and 6, is designed to receive a guide rope 14 for handling a ballast block 3, as illustrated in FIG. 8.

The gripper 2 comprises two gripping hooks, 15 and 16, respectively, articulated symmetrically on the horizontal pins 10 borne by the two ends of the lifting beam 4, each hook 15 or 16 thus passing through the gap 7 made between the two profiles 5 and 6.

Each gripping hook 15 or 16, extending substantially rectilinearly and obliquely on either side of its hinge pin 10, itself comprises:

- a front part situated under the lifting beam 4 and forming an inwardly directed hooking catch 17;
- a rear part 18 situated above the lifting beam 4 and serving as a counterweight;
- in the rear part 18, a welded locking control finger 19;
- at the end of this rear part 18, a hole receiving a transverse pin 20 for connecting the hook 15 or 16 to a handling sling (described later).

It will be noted that the protective plates 42 extend in the region in which the rear parts 18 of the two gripping hooks 15 and 16 travel, in order to protect the operator's hands.

The gripper 2 also comprises two pivoting locks, 21 and 22 respectively, articulated symmetrically on the horizontal pins 11 borne by the lifting beam 4, with a first lock 21 assigned to one of the gripping hooks 15, and a second lock 22 assigned to the other gripping hook 16.

Each lock 21 or 22 itself has a bent, hook-like shape, with:

a lower part 23 forming a counterweight, directed toward the corresponding end of the lifting beam 4;

an upper part 24 forming a locking catch;

on the upper part 24, a ramp 25 facing the front and intended to interact with the locking control finger 19 of the associated hook 15 or 16;

a transverse unlocking control rod 26.

Finally, the gripper 2 comprises two metal slings 27 and 28 that are arranged in the form of an inverted "V". At their lower ends, the two slings 27 and 28 are provided with respective rings 29 so that they can be connected to the rear ends of the two gripping hooks 15 and 16, respectively, each ring 29 being traversed by the pin 20 of the associated hook. The respective upper ends of the two slings 27 and 28 are connected to a common ring 30, for handling the gripper 2 in its entirety. It will be noted that each sling 27 or 28 forms and obtuse angle of less than 180° with the longitudinal axis of the corresponding gripping hook 15 or 16, providing a force for keeping the hooks 15 and 16 in the locked position when the gripper 2 is raised.

Moreover, the ballasting device comprises a specific design of the ballast blocks 3, which is adapted to the above-described gripper 2.

Each ballast block 3, made essentially of concrete, has an elongated parallelepipedal general shape, and comprises two metal inserts 31 and 32 embedded in the concrete while it is being cast. As shown in particular by FIG. 2, the two metal inserts 31 and 32 are arranged symmetrically on the ballast block 3, and each insert 31 or 32 is composed of a ballast block grip part 33, and of a part 34, for centering the blocks with respect to one another.

The grip part 33 is in the form of a flattened chimney stack extending over the entire height of the ballast block 3 and traversed, in its upper part, by a transverse pin 35. The spacing between the two transverse pins 35 belonging to the two inserts 31 and 32, respectively, corresponds to the horizontal distance between the respective hooking catches 17 of the two gripping hooks 15 and 16 of the gripper 2.

The centering part 34 extends vertically over the outer side of the grip part 33, to which it is attached by horizontal bars 36. Having the general shape of a rod, this centering part 34 comprises, at its top, a conical, preferably removable, centering peg 37 that protrudes above the upper face of the ballast block 3. At its base, the centering part 34 forms a housing 38 of conical or pyramidal shape that opens out in the lower face of the ballast block 3 and is intended to receive a centering peg of a lower ballast block. As shown in FIGS. 2, 7, 9 and 12, the two metal inserts 31 and 32 have different shapes as regards their respective housings 38. The centering part 34 situated to the right in the drawing has the general shape of a pyramid with a substantially square base. The other centering part 34, situated to the left, which is also represented in FIG. 13, has the general shape of a pyramid with a rectangular base elongated in the longitudinal direction of the ballast block 3.

The use of the ballasting device for placing ballast blocks 3 will now be described with reference to the successive figures of the drawing. Generally speaking, this use comprises hooking the ballast blocks 3, then handling them and finally unhooking them.

With reference first of all to FIGS. 2 and 3, hooking is carried out by bringing the gripper 2 itself above a ballast block 3, this gripper being suspended, by the upper ring 30, from a handling hook (not represented). At the start, the two gripping hooks 15 and 16 of the gripper 2 are locked, that is to say retained by means of the respective locks 21 and 22 in their position in which the two hooking catches 17 are raised, and spread apart to the maximum extent. The locked position of the gripping hooks is illustrated in particular, in the case of the hook 16, by FIG. 3, which shows how this hook 16 is retained in the lock 22 by its finger 19.

Figure 4:
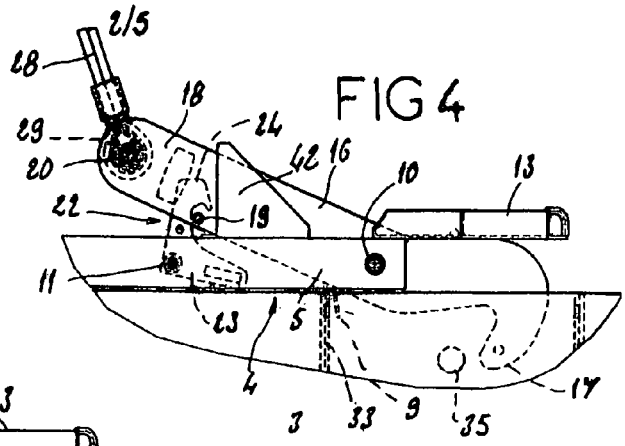

The gripper 2 is lowered toward the ballast block 3 and centered on this block 3 with the aid of the two right-angle centering brackets 8 and 9, which are placed at the edge of the housings delimited by the respective grip parts 33 of the two metal inserts 31 and 32—see FIG. 4.

Figure 5:
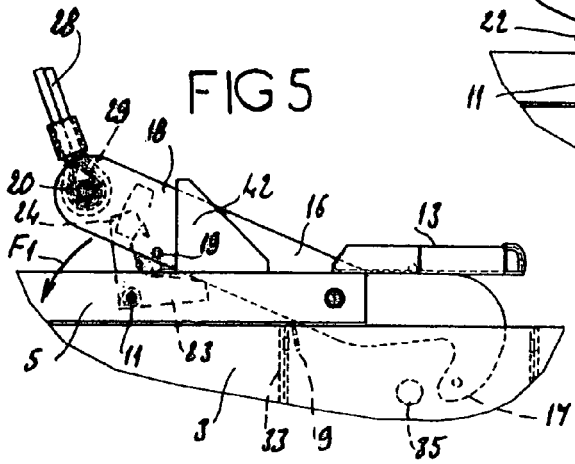
FIGS. 4, 5 and 6 are detail views similar to FIG. 3, illustrating successive positions of the hook during use of the device, more particularly in the phase of hooking a ballast block.

The operator then manually unlocks the two gripping hooks 15 and 16 by acting on the control rod 26 of each lock 21 and 22 so as to release the fingers 19 of the hooks 15 and 16. FIG. 5 illustrates this unlocking operation, the pivoting movement imparted manually to lock 22 visible here being indicated by the arrow F1.

Figure 6:
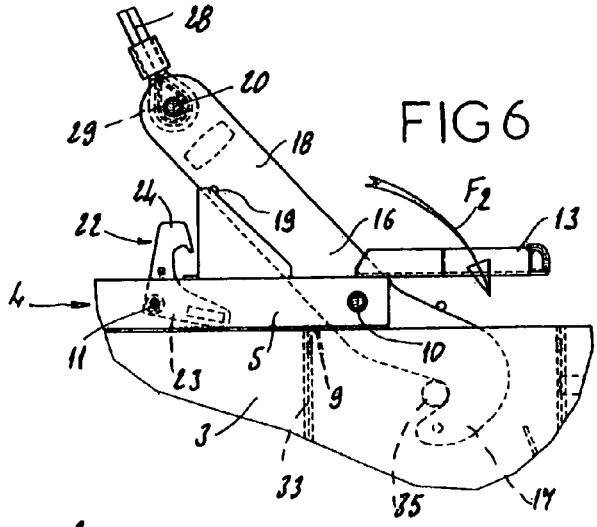

Next, hoisting of the assembly is initiated; the slings 27 and 28 are tensioned and the gripping hooks 15 and 16 pivot as indicated by the arrow F2, in the direction of lowering and contraction of their hooking catches 17. These hooking catches 17 then engage around the transverse pins 35 of the grip parts 33 of the ballast block 3. Reference may here be made more particularly to FIG. 6, which represents the enlarged detail B of FIG. 7.

Figure 7:
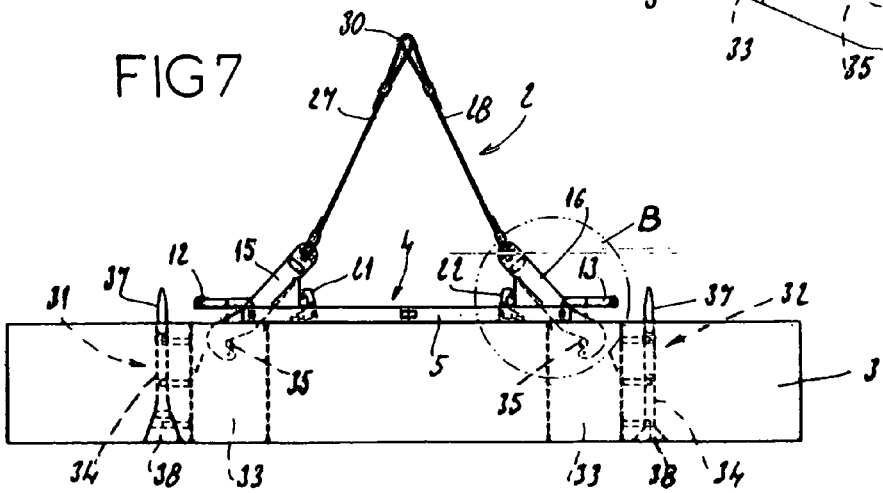
FIG. 7 is a front view similar to FIG. 2, showing the gripper while the ballast block is being hoisted.

The ballast block 3 is thus taken hold of by the gripper 2, in a hoisting position illustrated by FIG. 7. During the hoisting of the ballast block 3, the two gripping hooks 15 and 16 are kept in position by the weight of this block 3 alone, taking account of the angle of less than 180° formed by each sling 27 or 28 with the longitudinal axis of the corresponding hook 15 or 16.

Handling of the raised ballast block 3 is then performed, in order to bring it above the analogous ballast blocks 3 already put in place previously and stacked on the base frame 39 of the crane, above which the mast 40 of the crane rises—see FIG. 8. During this operation, the raised and displaced ballast block 3 is guided by the operator 41 stationed on the ground, by means of a rope 14 fastened to the lifting beam 4, more particularly to a terminal ring 13 of this lifting beam 4.

Figure 9:
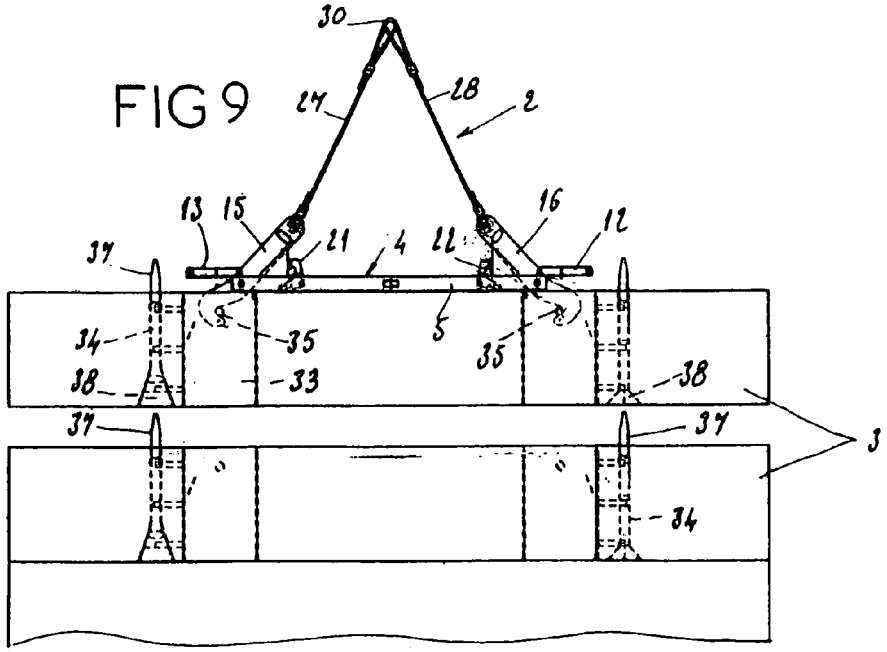
FIG. 9 is yet another front view, illustrating the stacking and centering of the ballast blocks.

The ballast block 3 is thus presented above the ballast blocks 3 already previously stacked, as shown by FIG. 9, the correct positioning of this ballast block 3 on the other blocks being provided by the centering parts 34. More particularly, the conical centering pegs 37 belonging to the previously placed ballast block 3 interact with the housings 38 of conical or pyramidal shape of the ballast block 3 being placed (FIG. 9 showing these elements just before they interact). During this operation, the housing 38 of specific pyramidal shape, with an elongated rectangular base, makes it possible to absorb deviations in positioning between the two ballast blocks 3, while guaranteeing correct alignment of the lateral faces of these two blocks 3.

The ballast block 3 in question is thus "self-centered" on the block 3 immediately below, against the upper face of which it finally bears.

Figure 10:
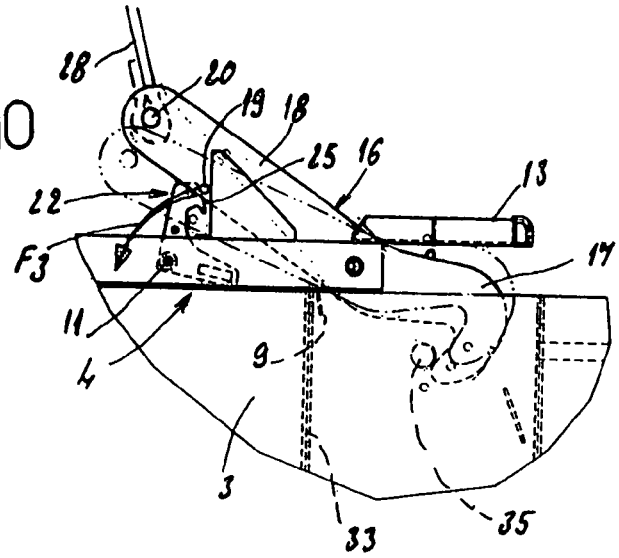
FIG. 10 is a detail view, illustrating the start of the automatic unhooking of the placed ballast block.
Figure 11:
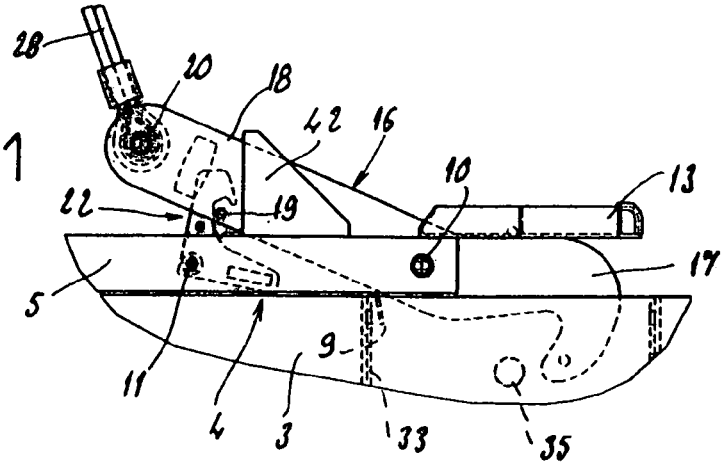
FIG. 11 is a view similar to FIG. 10, illustrating the end of the automatic unhooking of the ballast block.
Figure 12:
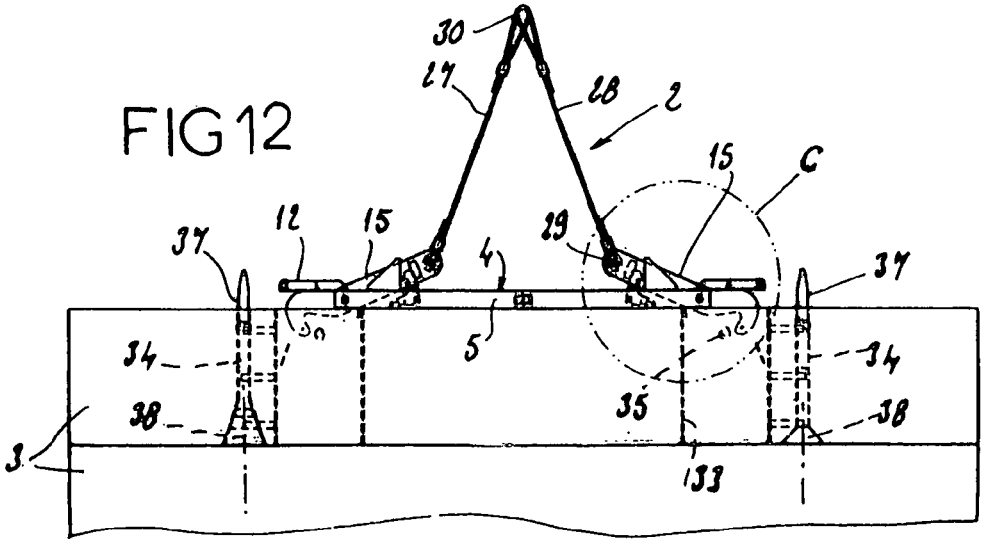
FIG. 12 shows, in front view, all of the device with its gripper unhooked from the last ballast block placed.
Figure 13:
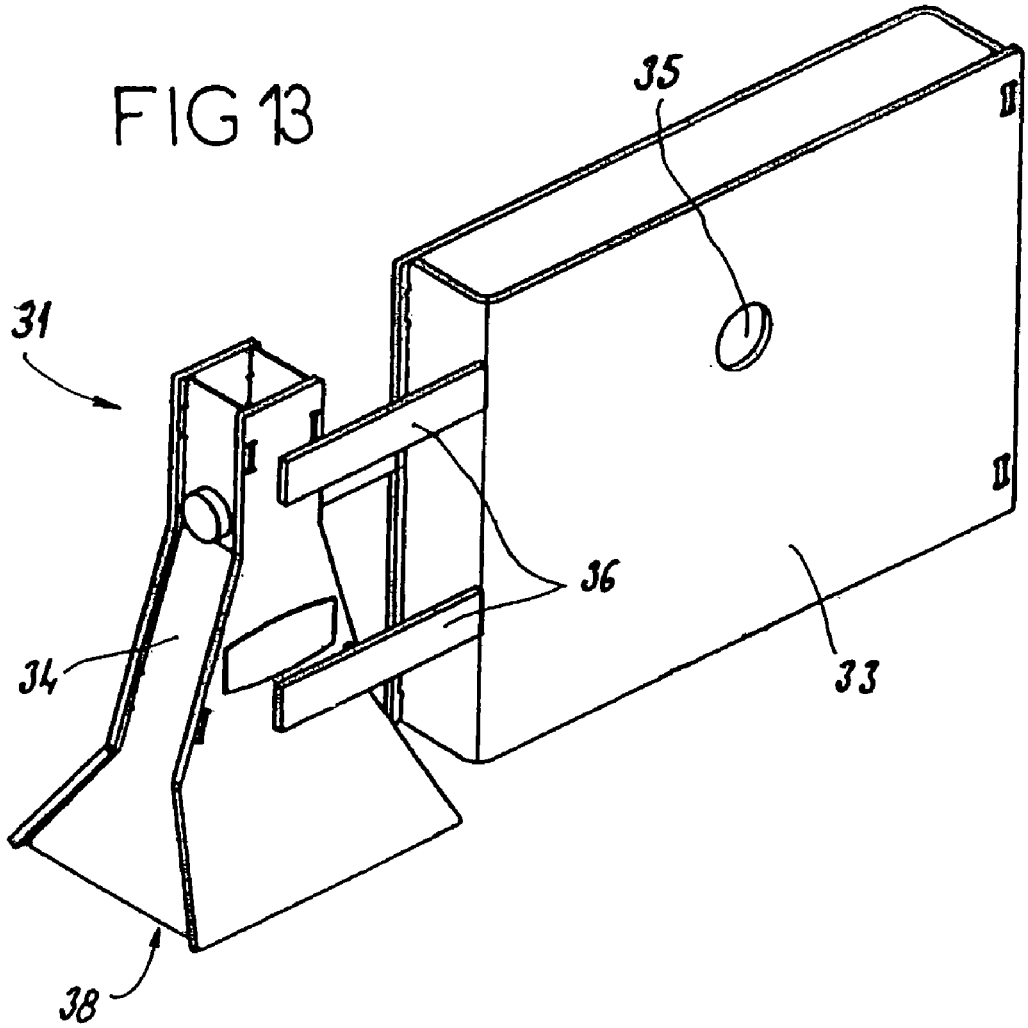
FIG. 13 represents, in perspective, a metal insert of the ballast block.

From this moment on, unhooking of the ballast block 3 that has just been placed still remains to be carried out, this last phase being illustrated by FIGS. 10 to 12. To this end, the downward movement of the handling hook is continued so that the slings 27 and 28 are slackened.

Under the effect of the counterweight constituted by their respective rear parts 18, the gripping hooks 15 and 16 initiate a tilting movement around the pivot pins 10, as indicated by the arrow F3 (in the case of the hook 16) in FIG. 10.

As the downward movement of the handling hook continues, the catches 17 of the gripping hooks 15 and 16 finally release the transverse pins 35 of the ballast block 3, as illustrated by FIG. 11, which represents the enlarged detail C of FIG. 12.

During the tilting of the gripping hooks 15 and 16, which takes place as the handling hook is lowered, the finger 19 of each of these hooks acts on the ramp 25 of the associated lock 21 or 22. The tilting of the locks 21 and 22, which takes place by gravity when the finger 19 arrives at the lower end of the ramp 25, causes the automatic locking of the two gripping hooks 15 and 16 by the respective locks 21 and 22.

The gripper 2 may then be moved away from the ballast block 3 that has just been placed, and this gripper 2 may be reused, in the manner described above, for taking hold of and placing the next ballast block 3, and so on.

It will be noted that the ballast blocks 3 may thus be stacked either in direct superposition (see FIGS. 9 and 12) or in a staggered formation as illustrated in FIG. 8.

One would not be departing from the scope of the invention, as defined in the appended claims, through structural modifications of the lifting beam, or through detail modifications of the shape of the gripping hooks and of their locks, or else through adaptation to ballast blocks of any dimensions and shapes.

The invention claimed is:

1. A ballasting device for a crane, combining ballast blocks that can be stacked onto a base frame of the crane, and a gripper for handling the ballast blocks, the gripper designed to be connected, during use, to a handling device that provides a nonpermanent connection, by hooking, between the gripper and a ballast block, and also centers stacked ballast blocks relative to one another, wherein the handling device comprises: two opposed gripping hooks mounted pivotably, about horizontal pins, in end regions of a lifting beam of the gripper, each gripping hook having, on one side of its pivot pin, a hooking catch designed to interact with a transverse pin placed in a corresponding housing of a ballast block, and, on the other side of its pivot pin, a rear part attached to a sling by which the gripper is suspended from a hoisting cable, each gripping hook provided with a lock that is borne by the lifting beam and designed to temporarily keep a corresponding gripping hook in a position in which the transverse pin is released.

2. The ballasting device for a crane according to claim 1, wherein the lifting beam comprises two parallel bars or profiles that are secured to one another with a longitudinal gap left between them, so as to form, at the two ends of the lifting beam, devises serving for the articulation of the two gripping hooks.

3. The ballasting device for a crane according to claim 2, wherein vertical protective plates are fastened onto the two parallel bars or profiles of the lifting beam, the vertical plates protecting the end region in which a rear part of each of the gripping hooks travels.

4. The ballasting device for a crane according to claim 1, wherein a rear part of each gripping hook comprises a counterweight.

5. The ballasting device for a crane according to claim 1, wherein each sling forms an angle of less than 180° with the longitudinal axis of the corresponding gripping hook.

6. The ballasting device for a crane according to claim 1, wherein each lock of the gripper is a lock mounted pivotably about a horizontal pin borne by the lifting beam, the lock having a bent shape, with a lower part forming a counterweight, and an upper part that forms a locking catch and is provided with a ramp that interacts with a control finger borne by a rear part of the corresponding gripper hook.

7. The ballasting device for a crane according to claim 1, wherein the ballast blocks, made essentially of concrete, each comprise two metal grip parts, embedded in the concrete, that each delimit a housing capable of partially receiving one of the two opposed gripping hooks, each metal grip part being provided with a transverse pin passing through the housing delimited by said part and designed to interact with the locking catch of a gripping hook engaged in the housing.

8. The ballasting device for a crane according to claim 7, wherein two right-angle positioning brackets are fastened under the lifting beam, the brackets designed to interact, respectively, with upper edges of the housing delimited by the two metal grip parts of the ballast block.

9. The ballasting device for a crane according to claim 1, further comprising a centering device for centering the stacked ballast blocks to one another, the centering device comprising: conical centering pegs that protrude above an upper face of the ballast block, and a pair of corresponding housings having a flared shape disposed at opposing ends of the ballast blocks, and the housing opens out in the lower face of the ballast block.

10. The ballasting device for a crane according to claim 9, wherein the housings have a general shape of a pyramid of rectangular base elongated in a longitudinal direction of the ballast block.

11. The ballasting device for a crane according to claim 9, wherein the centering pegs and the housings comprise metal centering parts, each metal centering part connected to a metal grip part to constitute a single metal insert embedded in the concrete of the ballast block.

12. The ballasting device for a crane according to claim 1, wherein the lifting beam is provided at its ends with rings designed to receive a guide rope that can be used while handling a ballast block hooked in under the lifting beam.

* * * * *